United States Patent [19]

Johnson

[11] Patent Number: 4,745,709

[45] Date of Patent: May 24, 1988

[54] GUTTER WITH CLEANING APPARATUS

[76] Inventor: Douglass M. Johnson, 7148 E. Brainerd Rd., Chattanooga, Tenn. 37421

[21] Appl. No.: 71,814

[22] Filed: Jul. 10, 1987

[51] Int. Cl.[4] ..... E04D 13/00

[52] U.S. Cl. ..... 52/2; 52/11

[58] Field of Search ..... 52/11, 12, 16, 2

[56] References Cited

U.S. PATENT DOCUMENTS 2,865,674 12/1958 Jelmeland ..... 52/16

3,157,002 11/1964 Herman ..... 52/12

*Primary Examiner*—John E. Murtagh

*Attorney, Agent, or Firm*—Alan Ruderman

[57] ABSTRACT

A building drain gutter has a flexible liner disposed in the trough of the gutter and connected in sealed relationship with upper edges of the gutter, the liner being loosely disposed within the trough and conforming to its configuration between the edges. A conduit is connected into the trough and communicates with an air compressor which when activated forces the liner to balloon upwardly out of the trough to remove debris which has accumulated thereon. The liner is a relatively thin plastic film such as vinyl. A downspout connected into the gutter communicates through a hole in the liner which is sealed with the trough about the hole. The liner acts to channel water to the downspout, yet can be lifted by the compressed air when necessary.

19 Claims, 1 Drawing Sheet

GUTTER WITH CLEANING APPARATUS

BACKGROUND OF THE INVENTION

This invention relates to the cleaning of debris from a gutter on a building, and more particularly to a gutter having a permanent flexible insert disposed therein and which selectively may be forced outwardly from the gutter channel to dislodge debris which has accumulated thereon.

On buildings having pitched roofs, such as most residential buildings, a gutter in the form of a trough conventionally is mounted at the lower edge of the roof or eaves to catch rain water and water from melted snow, the gutter acting to channel the water to downspouts which direct the water away from the foundation of the building. Over a period of time natural debris, such as fallen leaves, broken tree branches and bird feathers, and synthetic debris, such as roof beads of synthetic roof shingles and the like, gradually accumulate and obstruct the gutters and glog the downspouts thereby requiring periodic cleaning of the gutters which can be a hazardous chore and may require professional services.

Attempts have been made to minimize the accumulation of the debris within the gutter by placement of mesh or screen protectors superposed over the gutter. Such protectors generally have not been effective since they tend to separate from their attachments, usually beneath the edge of the lowermost roof shingles and the remote longitudinal edge of the gutter. Examples of protectors of this type are illustrated in Hitt U.S. Pat. No. 550,173 and Fry U.S. Pat. No. 2,219,953. Another proposal to prevent accumulation or such debris is illustrated in Schmitz U.S. Pat. No. 2,533,402 wherein a tubular screen conduit is placed in the gutter. The prior art abounds with other examples of protective devices such as illustrated in Hileman U.S. Pat. No. 4,592,174 and the art cited therein.

Additionally, gutter washing and mechanical gutter manipulating or agitating means have been proposed in the prior art. For example, in Thompson U.S. Pat. No. 2,887,073 a conduit disposed within or adjacent the gutter communicates with hot water supply means, the conduit having a multiplicity of apertures for spraying the water into the gutter in an attempt to wash out the debris. Since the debris is washed to the downspouts, the downspouts must be enlarged to prevent clogging thereof, and a debris catching basket is mounted therein to remove the debris. In Ward U.S. Pat. Nos. 4,061,151 and 4,116,008 and in Faye U.S. Pat. No. 4,413,449 gutters are disclosed which are constructed so that the gutter or portions thereof may be inverted by rotation about a pivot. Such proposals require specially constructed gutters and/or complicated gutter mounting structures which result in substantially increased costs of the gutters and do not appear to have found acceptance.

SUMMARY OF THE INVENTION

Consequently, it is a primary object of the present invention to provide a drain gutter for a building, the gutter having a flexible insert disposed within the interior thereof and adapted to be forceably moved outwardly away from the interior walls of the gutter selectively to dislodge debris that has accumulated thereon.

It is another object of the present invention to provide a drain gutter of conventional form and mounted in conventional manner, the gutter having a flexible liner loosely disposed therein, the liner conforming to the interior configuration of the gutter channel for receiving water and debris falling thereon and being sealed about the edges of the gutter, and fluid means channelled between the gutter and the liner for forceably urging the liner outwardly to dislodge the debris therefrom.

Accordingly, the present invention provides a drain gutter having a flexible liner loosely disposed in the internal channel thereof and sealed about portions of the periphery. A conduit is connected to the gutter and communicates the channel of the gutter with a fluid supply which is selectively actuated to force the liner away from the channel and dislodge debris which has accumulated on the liner.

In the preferred form of the invention the fluid supply is an air compressor which forces pressurized air into the space between the gutter channel and the liner effecting a ballooning of the liner away from the channel. As the liner is forceably lifted, the debris is thrown off its surface and away from the gutter. When the air pressure is released, the liner returns to its original disposition within the channel of the gutter.

By providing an appropriate sealing relationship of the liner with the peripheral edges of the gutter, the downspouts and the fluid supply conduit, the amount of fluid and the pressure thereof may be conserved so as to minimize the size of the compressor.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
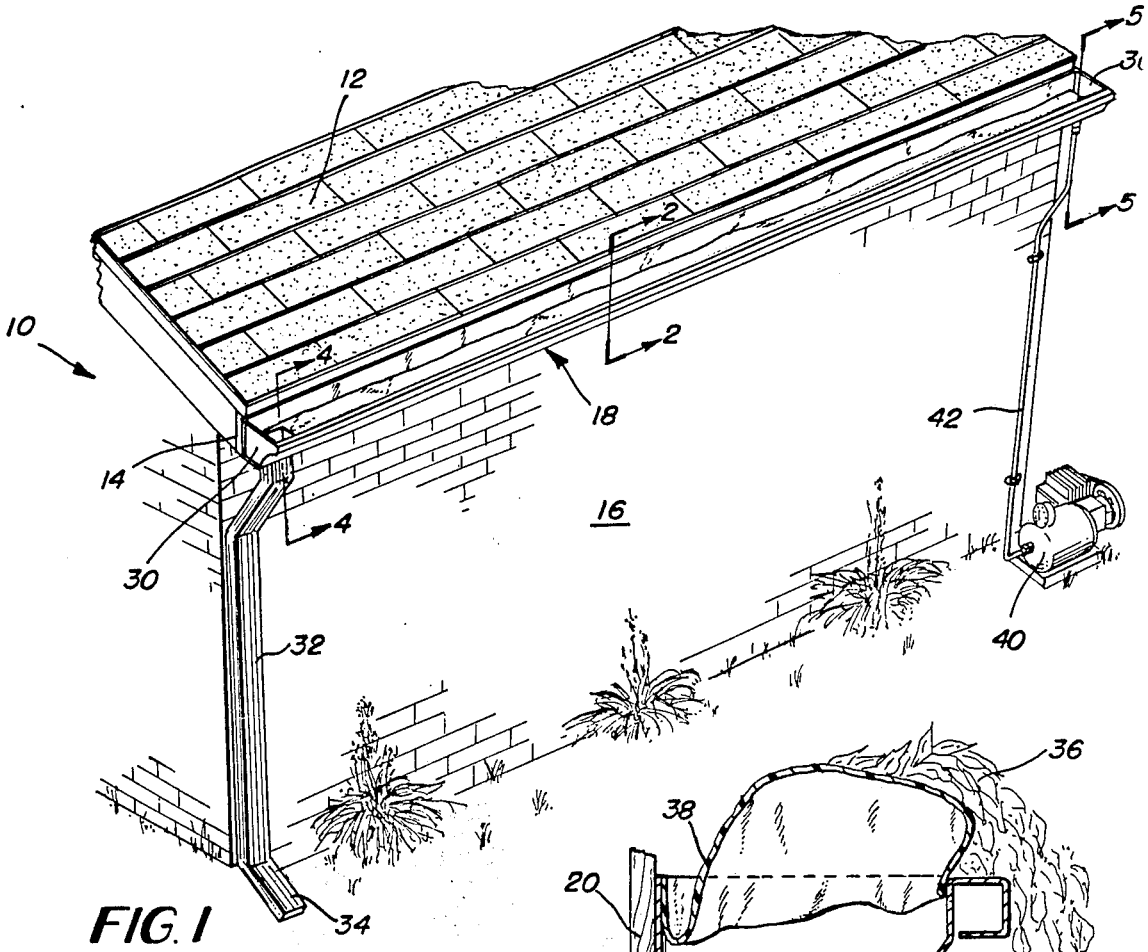
FIG. 1 is a perspective view of a fragment of a building having a gutter and apparatus for cleaning the gutter constructed in accordance with the principles of the present invention

Referring to the drawings, and particularly to FIG. 1, a building 10 is illustrated including a sloped roof 12 having a projecting portion or eave 14 overhanging the adjacent wall 16 of the building. A gutter 18 of any conventional cross sectional configuration is attached to the eave strip 20 at the edge of the eave. Any conventional means such as elongated nails or spikes or the like (not illustrated) may extend transversely through the gutter to secure the gutter directly to the eave strip 20 or secure brackets (not illustrated) which support the gutter.

The gutter 18 comprises an elongated sheet metal or plastic trough having a rear upstanding wall surface 22, a bottom surface 24 and a front upstanding wall surface 26 inclined upwardly in a fanciful and convenient manner and terminating at the front upper edge at a lip 28. The longitudinal ends of the gutter are closed by end caps 30 to contain water received within the gutter. The gutter is pitched slightly downwardly in a direction toward a downspout 32 which opens into the interior channel of the gutter and the water ideally flows down the gutter toward the downspout where at the lower end 34 it is directed away from the building and the foundation thereof.

As aforesaid, over a period of time various debris 36 normally accumulates within the gutter, such debris presenting an obstacle against the free flow of the water within the gutter. Additionally, such debris will normally clog the entrance from the gutter into the downspout causing the water to overflow out of the gutter channel and rendering the gutter inefficient for its intended purpose.

In accordance with the present invention a liner 38 in the form of a flexible sheet of material is loosely disposed within the interior channel of the gutter and attached to the walls 22 and 26 at upper portions thereof. Preferably, the liner is a thin sheet of plastic film material and is of a size such that longitudinally it extends the length of the gutter, or the length of gutter sections in those instances where the gutter is of a length requiring it to be formed from a number of assembled sections, and the width of the liner is such that in its normal or relaxed condition it will conform to the interior configuration of the gutter so as to form the flow channel for the water. Except for the attachment points along the upper portion of the walls 22 and 26, and at locations where the gutter connects to the downspout 32 and other connecting members as hereinafter described, the liner is loose fitting or free of the gutter, merely resting therein by reason of its weight. The liner should have sufficient strength to endure the stresses placed thereon and the natural weather elements, and it has been found that vinyl or similar plastic material functions satisfactorily for this purpose. Because the liner, except at its connection points with the gutter, is free it can be lifted or moved upwardly relative to the internal channel of the gutter and when so lifted any debris accumulated thereon may be lifted out of the confines of the gutter. When the liner is forceably lifted out of the gutter any debris thereon will be thrown outwardly and dislodged from the confines of the interior of the gutter.

Figure 3:
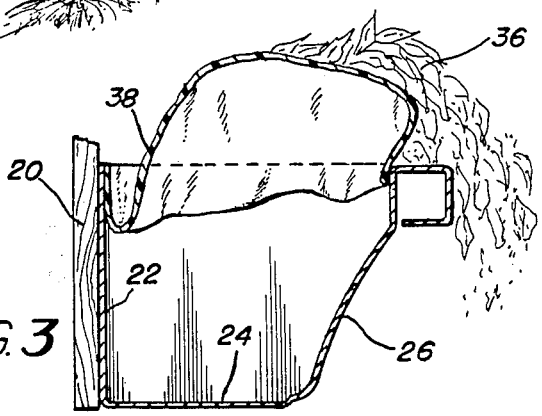
FIG. 3 is a view similar to FIG. 2, but illustrating the disposition of the liner while fluid is applied to force the liner outwardly outwardly from the gutter channel.
Figure 2:
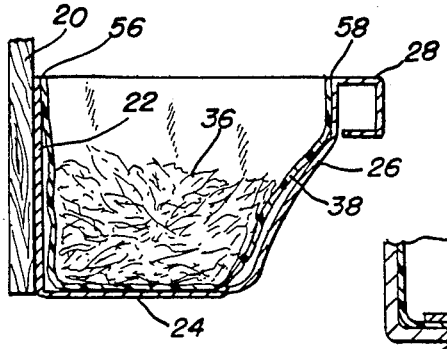
FIG. 2 is a transverse cross sectional view taken through the gutter substantially along the line 2—2 of FIG. 1 illustrating debris disposed on the liner.
Figure 4:
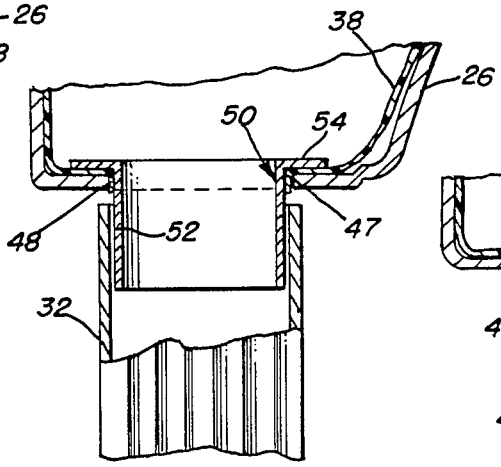
FIG. 4 is a transverse cross sectional view taken substantially along line 4—4 of FIG. 1 through a downspout.
Figure 5:
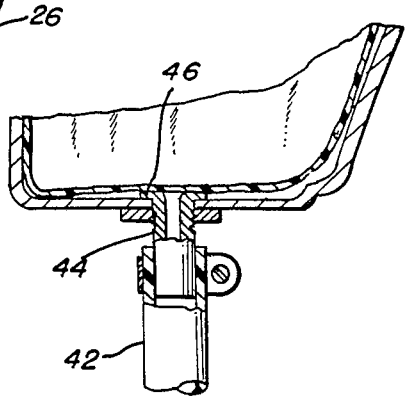
FIG. 5 is a tranverse cross sectional view taken through a portion of the fluid supply conduit substantially along the line 5—5 of FIG. 1.

In order to forceably lift the liner, the invention communicates a fluid into the gutter between the liner and the interior surface of the gutter. In the preferred form of the invention the fluid is air which is supplied by a compressor 40 located either within or outside the building. The compressor communicates with a conduit 42 which extends upwardly along the building and may be connected into the bottom surface 24 of the gutter oy a fitting 44 or the like having an annular rim or flange 44 which abuts the inner surface of the bottom of the gutter to provide a seal. When cleaning of the gutter is required, the compressor may be actuated to force pressurized air into the gutter thereby to forceably lift or balloon out the liner from the channel of the gutter and discharge the debris as illustrated in FIG. 3.

In order to mount the downspout 32 so that it communicates with and receives water from the channel formed by the liner when disposed within the gutter trough, the liner at the location of the downspout and the downspout opening 47 in the gutter may have an aperture 48 for receiving an adapter 50 in the form of a short tube 52 including an annular flange 54 at one end, the other end of the tube 52 may then extend through the aperture 48 and be received within the downspout while the flange 54 is positioned tightly on the liner about the aperture 48. The adapter 50 may be pressed into the opening 47 onto the liner to provide a seal against leakage of water through the opening 48 between the liner and the tube and a seal to prevent leakage of air through the opening 47 between the liner and the gutter when the compressor is actuated. Similar means may be utilized to provide seals between adjacent portions of the liner where sections of the gutter connect. Effectively such seals are akin to metal flashing utilized on roofs to seal the section between the roof and structures extending through the roof, such as a chimney. The seals act to prevent water leakage between adjacent sections of the liner and air leakage between the liner and the gutter at the gutter joints while permitting the air to flow between the liner sections and the gutter sections.

To provide a good seal between the liner and the gutter at the attachment points with the walls 22, 26 the liner may be bonded thereto. This may be accomplished by a waterproof glue or preferably by heat applied at the connections. Thus, a bond may be made longitudinally along the attachment edges 56, 58 and such bond may be formed at the time the gutter is manufactured. Most gutters are formed by bending of sheet metal using a series of rollers. Accordingly, in the process of forming the gutter the liner may be attached to the metal at the edges 56, 58 by applying heat to rollers acting on those edges, or the metal may be tightly crimped at those edges about the respective edges of the liner to sandwich those edges of the liner between the crimped portions of the metal. Of course, the liner may be riveted to the gutter, but air would leak between the rivets and this would require the compressor to be larger than required if the liner were bonded to the gutter. In those instances where the gutter comprises plastic, heat staking of the liner to the gutter would be most suitable.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spririt of the invention are intended to be included within the scope of the appended claims.

Having thus set forth the nature of the invention, what is claimed herein is:

1. A building drain gutter having apparatus for permitting periodic cleaning of debris accumulated therein, said gutter comprising an elongated trough including transversely spaced apart substantially upstanding wall surfaces separated by and integral with a bottom surface, each of said wall surfaces having upper extremities, a liner comprising a sheet of flexible material loosely disposed within the tough, said liner having transversely spaced apart edges, means for securing each of said edges of the liner to a respective one of said wall surfaces proximate said upper extremities for enclosing the trough so that debris accumulates on the liner rather than in the trough, an aperture formed in said trough, a conduit communicating with said aperture, and means for supplying a fluid to said conduit under pressure through said aperture into the trough for pressurizing said trough and forceably urging said liner upwardly between said edges out of the trough with the accumulated debris.

2. A building drain gutter as recited in claim 1, wherein said liner comprises a sheet of plastic film material.

3. A building drain gutter as recited in claim 2, wherein said film comprises vinyl.

4. A building drain gutter as recited in claim 1, wherein said means for supplying fluid comprises and air compressor.

5. A building drain gutter as recited in claim 4, wherein said liner comprises a sheet of plastic film material.

6. A building drain gutter as recited in claim 5, wherein said film comprises vinyl.

7. A building drain gutter as recited in claim 2, wherein said edges of said liner are secured to upper edges of said wall surfaces in substantially sealed relationship.

8. A building drain gutter as recited in claim 7, wherein said liner comprises a sheet of plastic film material.

9. A building drain gutter as recited in claim 8, wherein said film comprises vinyl.

10. A drain gutter for a building comprising an elongated open top trough having transversely spaced apart upstanding wall surfaces interconnected by a bottom surface, a liner comprising a sheet of flexible material having transversely spaced edges fastened to said upstanding wall surfaces proximate respective upper extremities and loosely disposed between said edges in the trough, said liner having a transverse dimension such that the liner while disposed in said trough conforms substantially to said bottom surface and said upstanding wall surfaces intermediate said edges, an aperture formed in said gutter intermediate said edges, conduit means communicating with said aperture, and fluid supply means for communicating with said conduit means for supplying a fluid into said aperture under pressure to pressurize the trough and to lift said liner upwardly between said edges out of the trough, said pressure being sufficient to lift said liner together with debris accumulated thereon to dislodge said debris.

11. A drain gutter as recited in claim 10, including at least one downspout fastened to said trough, said liner having an opening communicating with said downspout, and means for sealing said liner with said trough about said opening.

12. A drain gutter as recited in claim 10, wherein said fluid supply means comprises a compressor for supplying air under pressure.

13. A drain gutter as recited in claim 12, wherein said liner comprises a sheet of plastic film material.

14. A drain gutter as recited in claim 13, wherein said film comprises vinyl.

15. A drain gutter as recited in claim 11, wherein said fluid supply means comprises a compressor for supplying air under pressure.

16. A drain gutter as recited in claim 15, wherein said liner comprises a sheet of plastic film material.

17. A drain gutter as recited in claim 16, wherein said film comprises vinyl.

18. A drain gutter as recited in claim 16, including means for sealing said liner with said upstanding wall surfaces.

19. A drain gutter as recited in claim 18, wherein said film comprises vinyl.

* * * * *